US006217419B1

(12) United States Patent
Maury et al.

(10) Patent No.: US 6,217,419 B1
(45) Date of Patent: Apr. 17, 2001

(54) CHEMICAL-MECHANICAL POLISHER

(75) Inventors: Alvaro Maury; Jose Rodriguez, both of Orlando, FL (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/375,085

(22) Filed: Aug. 16, 1999

(51) Int. Cl.[7] ..... B24B 1/00
(52) U.S. Cl. ..... 451/41; 451/287
(58) Field of Search ..... 451/41, 285, 286, 451/287, 288, 289, 24, 36

(56) References Cited

U.S. PATENT DOCUMENTS

| | | | | |
|---|---|---|---|---|
| 5,643,061 | | 7/1997 | Jackson et al. . | |
| 5,664,989 | * | 9/1997 | Nakata et al. | 451/41 |
| 5,816,900 | * | 10/1998 | Nagahara et al. | 451/285 |
| 5,851,136 | | 12/1998 | Lee . | |
| 5,876,271 | | 3/1999 | Oliver . | |
| 5,908,530 | | 6/1999 | Hoshizaki et al. . | |
| 5,913,714 | | 6/1999 | Volodarsky et al. . | |
| 6,083,083 | * | 7/2000 | Nishimura | 451/41 |

* cited by examiner

*Primary Examiner*—Joseph J. Hail, III
*Assistant Examiner*—Dung Van Nguyen
(74) *Attorney, Agent, or Firm*—Allen, Dyer, Doppelt, Milbrath & Gilchrist, P.A.

(57) ABSTRACT

A chemical-mechanical polishing apparatus includes a polishing table having a top surface and an annular trench formed in the top surface and defining an annular configured polishing area in the polishing table. A drive mechanism rotates the polishing table. An annular diaphragm is positioned within the annular configured polishing area and has a top surface and bottom surface. An annular configured polishing pad is positioned on the diaphragm. A fluid actuated pressure mechanism is associated with the annular configured polishing area for exerting pressure upward onto the bottom surface of the annular diaphragm as a polishing table rotates for exerting an upward biasing pressure onto the polishing pad and imparting a desired counter force against any downward pressure exerted against a semiconductor wafer during chemical-mechanical polishing.

14 Claims, 4 Drawing Sheets

CHEMICAL-MECHANICAL POLISHER

FIELD OF THE INVENTION

This invention relates to the field of chemical-mechanical polishing, and more particularly, this invention relates to the field of chemical-mechanical polishing using a polishing table that provides a counter force against downward pressure exerted by a semiconductor wafer carrier.

BACKGROUND OF THE INVENTION

Different types of prior art rotary polishers are used in chemical-mechanical polishing of semiconductor wafers, where a thin layer of semiconductor material is planarized during the overall semiconductor manufacturing operation. The chemical-mechanical polishers typically have a heavy, circular polishing table made from a metal material or rigid ceramic material. The top surface is usually machined flat or formed smooth, and a polishing pad is glued onto the top surface. The polishing table is a predetermined diameter that is larger than the diameter of any semiconductor wafer that will be planarized in the chemical-mechanical polishing step. An abrasive slurry is fed onto the top surface of the polishing table. Typically, a semiconductor wafer carrier is positioned over the polishing table at a position for engaging the top polishing surface. The semiconductor wafer carrier holds the semiconductor wafer through an appropriate mechanism and places the semiconductor wafer against a polishing pad that is positioned on the top surface of the polishing table.

Standard prior art polishing pads in some rotary polishers usually consist of a stack with a hard layer on top of a soft under-pad. The hard pad produces a local planarization of topographical features, while the soft layer allows the stack to conform globally to the wafer shape. The use of a soft under-layer degrades the planarization ability of the top pad. However, a single layer hard pad cannot be used on a standard rotary polisher because high spots in the wafer will polish preferentially, resulting in very poor within-wafer uniformity. In order to improve global uniformity, the downward biasing force can be increased to a very high value, about 10 pounds per square inch, which flattens the semiconductor wafer and allows the pad to conform better to the semiconductor wafer. However, within-die uniformity is degraded as the downward directed force increases.

One recently developed chemical-mechanical polishing tool uses a "belt sander" approach. A single hard pad is mounted on a thin metal belt. The linear motion of the belt is used to polish the wafer. Good global uniformity can be achieved by tailoring the pressure behind the metal belt under the wafer. However, it is not always desirable to use a reciprocating movement because the technology of most chemical-mechanical polishing tools are directed to the rotary type of polishing table. An example of a reciprocating polishing table is the rectangular configured table shown and disclosed in U.S. Pat. No. 5,908,530 to Hoshizaki et al.

SUMMARY OF THE INVENTION

It is therefore an object of the present invention to provide a chemical-mechanical polishing apparatus using a rotary polishing table that can be used in conjunction with a low down-force (less than 5 psi) and a high rotary table speed to maintain a high removal rate without sacrificing the thin wafer uniformity.

In accordance with the present invention, a chemical-mechanical polishing apparatus includes a polishing table having a top surface and an annular trench formed in the top surface and defining an annular configured polishing area in the polishing table. A drive mechanism rotates the polishing table. An annular diaphragm positioned within the annular configured polishing area. The annular diaphragm has a top surface and a bottom surface. A fluid actuated pressure mechanism is associated with the annular configured polishing area and exerts pressure upward onto the bottom surface of the annular diaphragm as the polishing table rotates for exerting an upward biasing pressure onto a polishing pad and imparting a desired counter force against any downward pressure exerted against by semiconductor wafer carrier during chemical-mechanical polishing.

The fluid actuated pressure mechanism includes a circular fluid head positioned under the polishing table in a predetermined area of the annular configured polishing area in which a semiconductor wafer will be positioned. It includes a plurality of fluid directing orifices through which fluid is directed through the fluid head upward against the bottom surface of the annular diaphragm.

In still another aspect of the present invention, an annular trench is formed within the polishing table and defined as the annular configured polishing area in the polishing table. A plurality of supports extend across the annular trench for supporting the annular diaphragm. In still another aspect of the present invention, a semiconductor wafer carrier is positioned over the polishing table at a position for engaging the top polishing surface of the annular diaphragm and holding a semiconductor wafer and placing the semiconductor wafer against a polishing pad positioned on the top surface of the polishing table. The top polishing surface of the annular diaphragm is preferably substantially coplanar with the top surface of the polishing table. A source of fluid can be connected to the fluid actuated pressure mechanism for supplying fluid under pressure. The source of fluid can comprise an air pump. The fluid actuated pressure mechanism can also include a plurality of concentric fluid carrying tubes for exerting pressure against the bottom of the annular diaphragm.

In still another aspect of the present invention, the chemical-mechanical polishing apparatus includes a polishing table having a top surface and an annular trench formed in the top surface that is dimensioned wider across the trench than the diameter of a semiconductor wafer to be polished. A drive mechanism rotates the polishing table and a biasing mechanism is positioned within the annular trench and comprises a plurality of concentric fluid carrying tubes positioned within the trench for carrying fluid under pressure.

An annular diaphragm is placed within the annular trench and engages the biasing mechanism. The annular diaphragm has a top surface for polishing a semiconductor wafer. A predetermined fluid pressure within the fluid carrying tubes exerts a desired upward biasing pressure through the biasing mechanism onto the annular diaphragm for imparting a desired counter force via a polishing pad against downward pressure exerted against a semiconductor wafer during chemical-mechanical polishing.

In still another aspect of the present invention, the chemical-mechanical polishing apparatus includes a polishing table having a top surface and a plurality of openings extending through the polishing table in an annular configuration to form an annular configured polishing area in the polishing table. Each opening is dimensioned wider than the diameter of a semiconductor wafer to be polished. A drive mechanism rotates the polishing table and an annular diaphragm is formed from a substantially rigid material positioned within the annular configured polishing area. The annular diaphragm has a top polishing surface and bottom surface.

A fluid directing mechanism is positioned under the polishing table at a predetermined area of the annular configured polishing area in which a semiconductor wafer is to be positioned for directing fluid under pressure and upward through the openings as the polishing table rotates, and onto the bottom surface of the annular diaphragm and onto the polishing pad. It thus exerts an upward biasing pressure onto the annular diaphragm and imparts a desired counter force against any downward pressure exerted against a semiconductor wafer carrier during chemical-mechanical polishing.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention is advantageous because it now provides a chemical-mechanical polishing apparatus and associated method using a novel and unobvious chemical-mechanical polishing set-up where a single layer hard pad can be used in conjunction with a low downward directed force, such as less than 5 psi, and a high rotating table speed to maintain a high removal rate without sacrificing the thin wafer uniformity.

Figure 1:
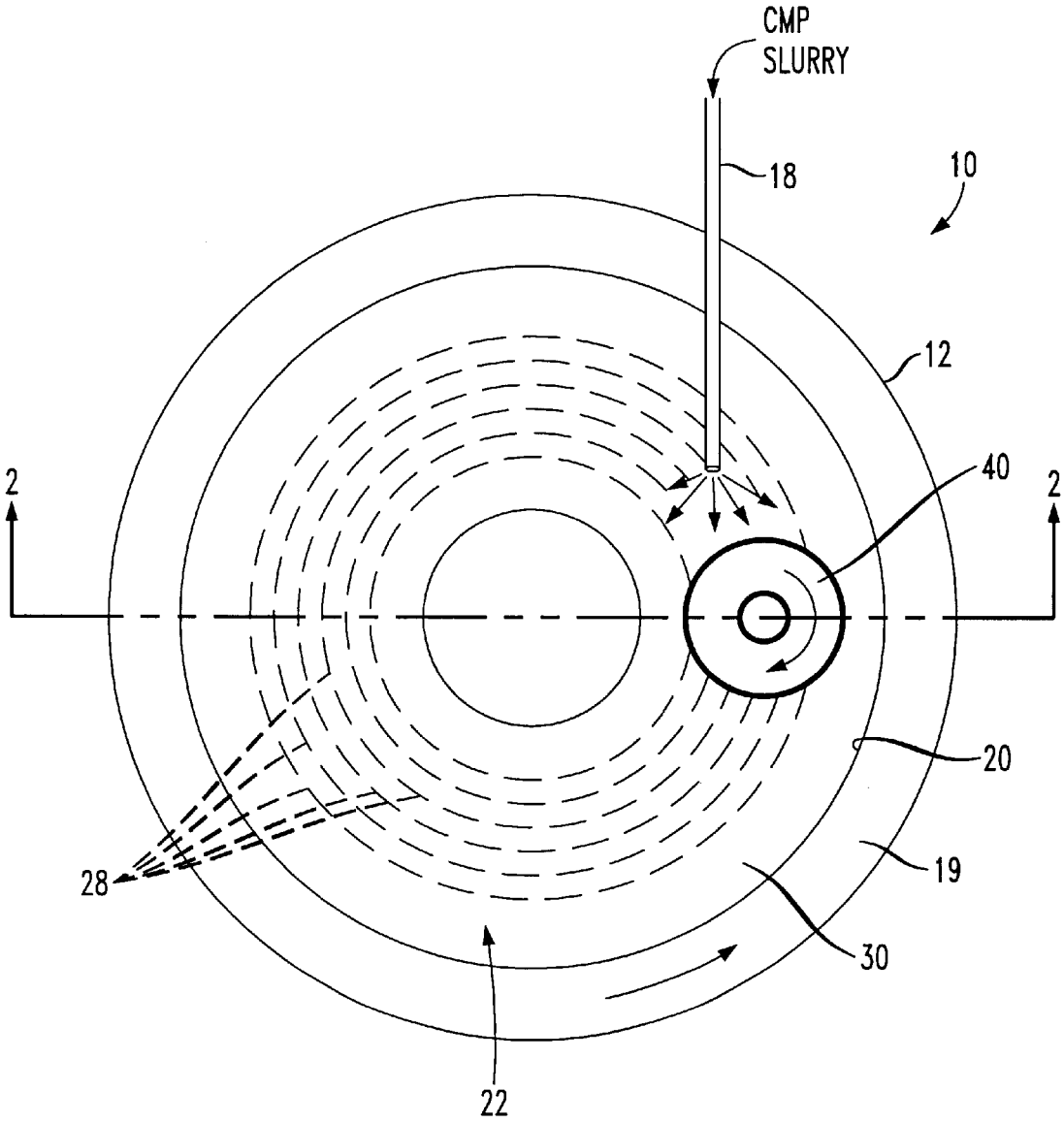
FIG. 1 is a top plan view of a chemical-mechanical polishing apparatus of the present invention.
Figure 2:
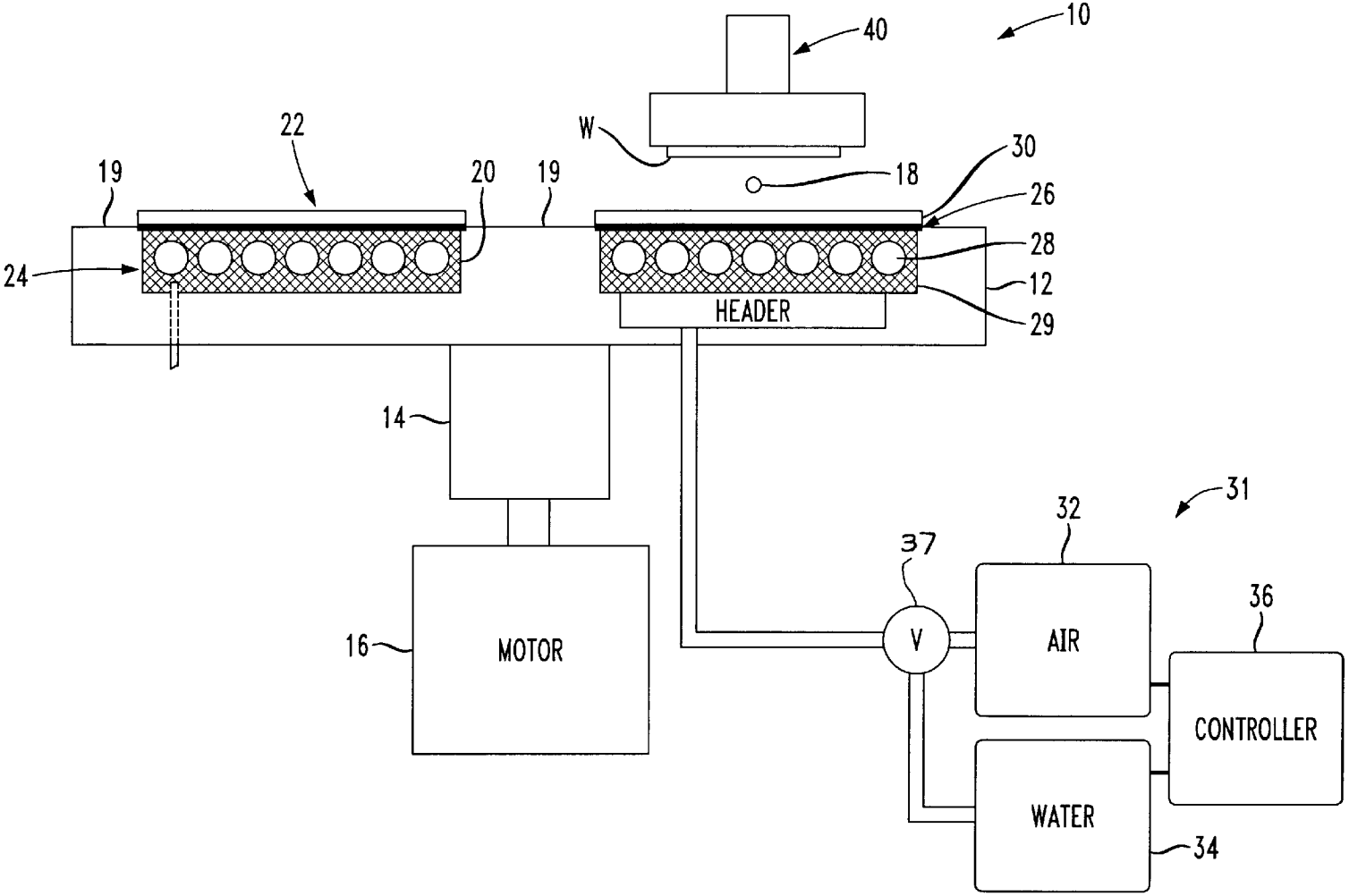
FIG. 2 is a cross-section of one aspect of the chemical-mechanical apparatus of the present invention taken along line 2—2 of FIG. 1 and showing a biasing mechanism that carries a plurality of concentric fluid carrying tubes.

Referring now to FIGS. 1 and 2, there is illustrated a first aspect of the present invention with a plan view of the chemical-mechanical polishing apparatus 10 of the present invention and a schematic cross-section view shown in FIG. 2. The chemical-mechanical polishing apparatus 10 includes a polishing table 12, such as formed from a metal or ceramic material, as known to those skilled in the art. The polishing table 12 includes a vertical spindle 14 connected to the bottom surface of the polishing table 10. The spindle is connected to a drive motor 16 that provides the drive force necessary for rotating the polishing table 12 at high operating speeds with increased revolutions per minute. The drive motor 16 could be directly connected to the spindle as illustrated, or connected to a drive mechanism, such as a pulley (not illustrated). The spindle 14 could be secured to the bottom surface of the polishing table by appropriate fasteners, such as bolts or by welding, if there is metal-to-metal contact.

The polishing table 12 also has a top surface 19 that is a larger diameter than the diameter of a semiconductor wafer W to be polished via the chemical-mechanical polishing apparatus 10. As is well known to those skilled in the art, an abrasive slurry is pumped via slurry delivery system 18 onto the top surface 19 of the polishing table to provide the necessary chemical and abrasive action used in chemical-mechanical polishing to planarize the surface of a semiconductor wafer.

In accordance with the present invention, the polishing table includes an annular trench 20 formed in the top surface 19 and defines an annular configured polishing area, indicated generally at 22, in the polishing table 12. In the embodiment shown in the FIG. 2 cross-section, the annular trench 20 is formed as a milled surface, such as could be formed in a ceramic or metal polishing table 12. In that aspect of the invention shown in FIG. 2, the trench 20 does not extend completely through the polishing table, but forms a channel with a bottom surface, as illustrated. A fluid biasing mechanism, indicated generally at 24, is positioned within the annular trench 20. An annular diaphragm 26, such as formed from a substantially thin but rigid material, such as a thin metal, is positioned over and preferably on top of the fluid biasing mechanism 24. Other rigid materials could be used for the diaphragm as suggested by those skilled in the art.

The annular trench 20 is formed wider than the wafer diameter that will be chemically-mechanically polished on the polishing table. The annular trench 20 shown in FIG. 2 actually forms an annular channel having a depth to allow a fluid biasing mechanism in the form of concentric fluid carrying tubes 28 contained within a rubber matrix 29 to engage the annular diaphragm, as will be explained below. An annular configured polishing pad 30 is positioned on the annular diaphragm on which the chemical-mechanical polishing occurs. The polishing pad is illustrated a annular configured, but could be other shapes as suggested by those skilled in the art, as long as the annular diaphragm exerts the necessary pressure. The annular diaphragm 26 could be formed substantially coplanar with the top surface 19 of the polishing table.

The fluid carrying tubes 28 are positioned in the annular trench 20 and connect to a source of fluid pressure 31, such as an air source 32 or fluid source 34. The fluid carrying tubes 28 are preferably flexible to allow expansion within the rubber matrix 29. Thus, a controller 36 can be connected to the source of fluid pressure 31 to change the pressure exerted within the fluid carrying tubes 28 and expand the rubber matrix 29 onto the bottom surface annular diaphragm to which it is engaged and against the polishing pad 30 positioned on the annular diaphragm 26 to exert a desired upward biasing pressure through the biasing mechanism formed by the rubber matrix and fluid carrying tubes onto the annular diaphragm and thus the polishing pad. As a result, a desired counter force is imparted against downward pressure exerted against a semiconductor wafer during chemical-mechanical polishing. It is possible to place a valve 37 into the fluid carrying tubes. The valve could be adjusted to adjust pressure.

As illustrated, a semiconductor wafer carrier 40 is positioned over the polishing table 12 at a position for engaging the top polishing surface of the polishing pad 30 positioned on the annular diaphragm. The wafer carrier 40 holds and places the semiconductor wafer against the top polishing surface of the polishing pad 30. The semiconductor wafer carrier 40 can hold the semiconductor wafer by vacuum or other techniques, as well known to those skilled in the art. The wafer carrier 40 can be moved downward to apply a predetermined pressure, which is then counteracted by the fluid biasing mechanism 24 against the annular diaphragm 26 positioned within the annular trench.

Figure 3:
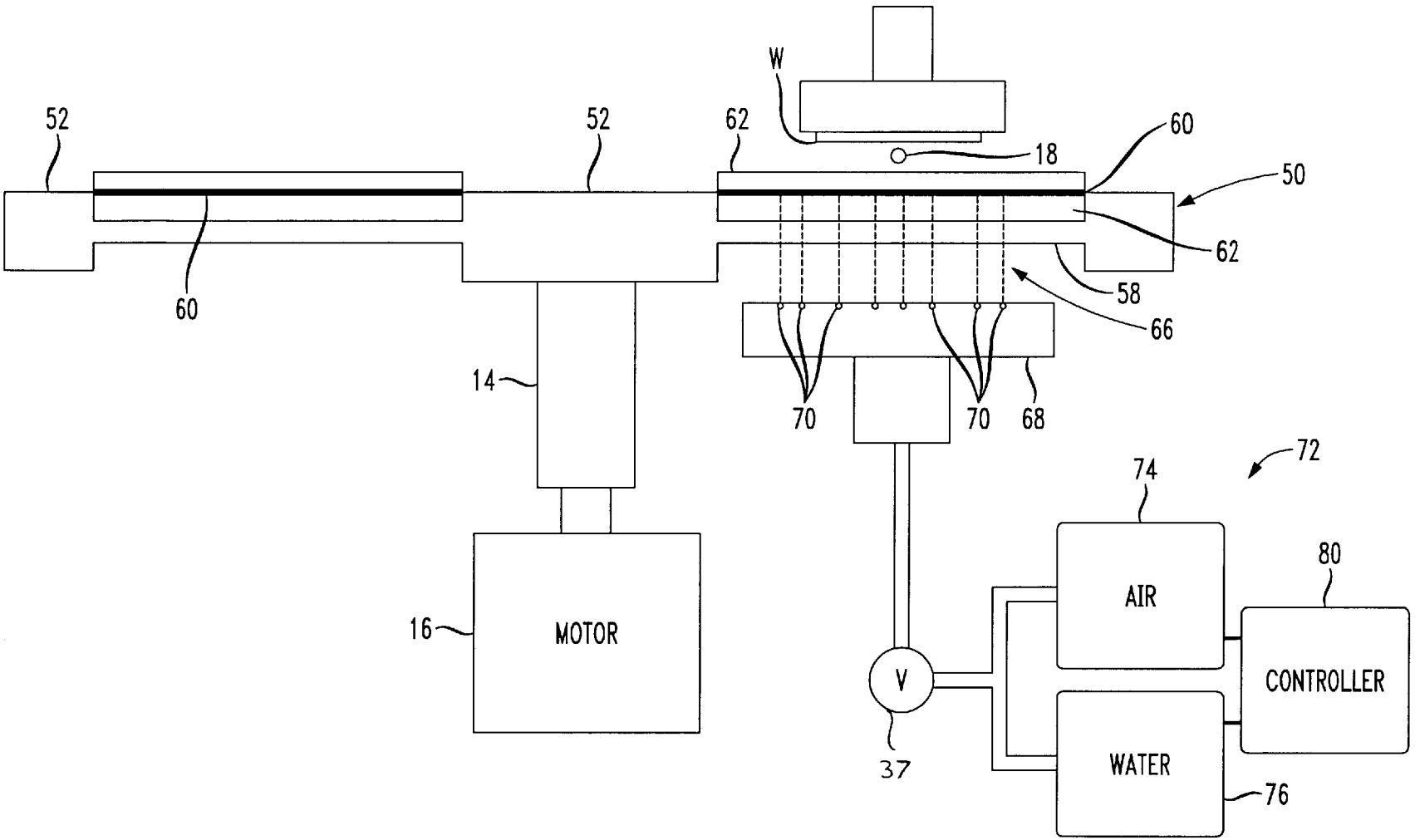
FIG. 3 is another schematic cross-section drawing of one aspect of the present invention showing the use of a fluid directing mechanism positioned under the polishing table at a predetermined area of an annular configured polishing area.
Figure 4:
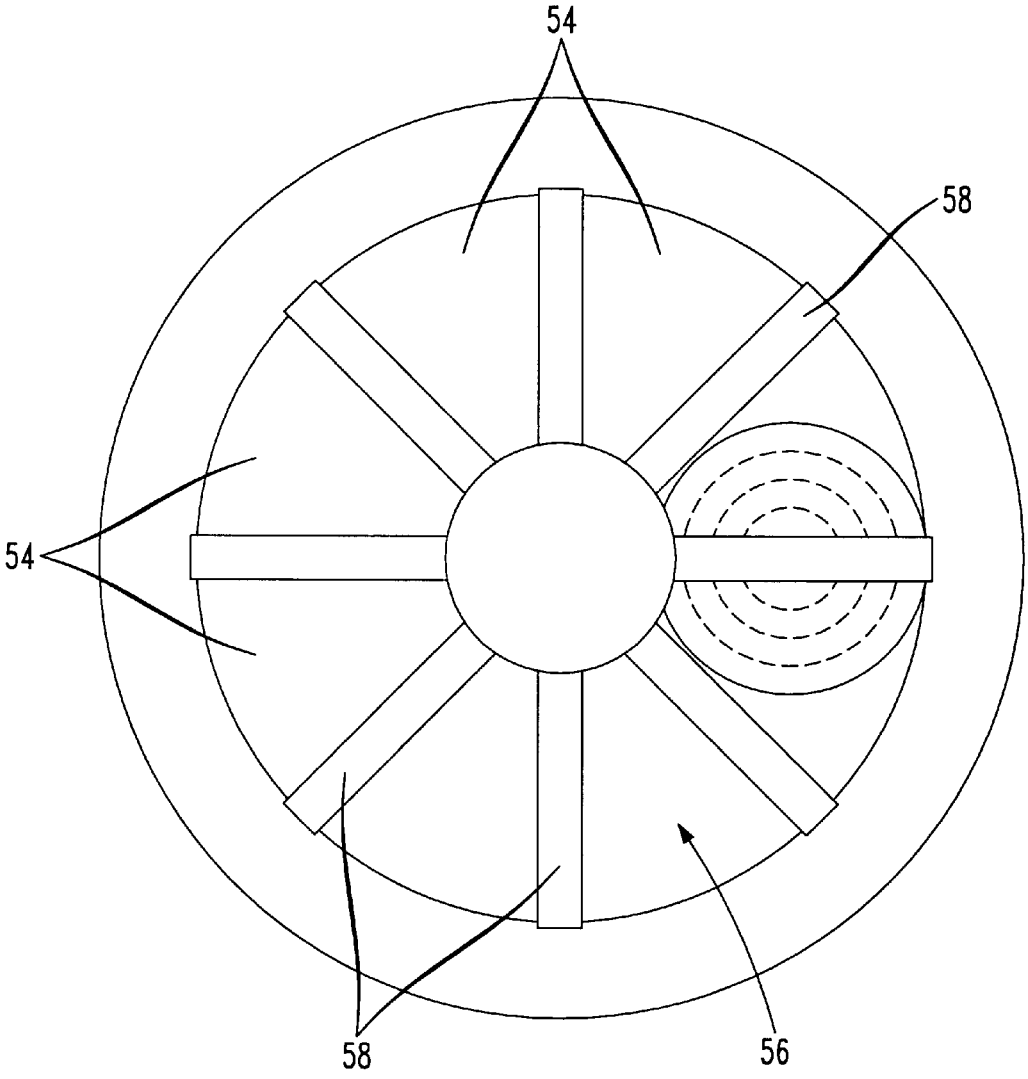
FIG. 4 is a top plan view of a polishing table without the diaphragm, and the polishing pad to show the fluid directing mechanism formed as a circular fluid head.

In still another aspect of the present invention shown in FIGS. 3 and 4, the polishing table 50 has a top surface 52 and a plurality of openings 54 extending through the polishing table in an annular configuration to form the annular configured polishing area 56 in the polishing table 50 (FIG. 4). Each opening 54 is dimensioned wider than the diameter of the semiconductor wafer to be polished. A plurality of supports 58, such as wheel spokes, extend across the annular trench (or channel) that extends through the polishing table and defines supports for supporting an annular diaphragm 60. A support pad 62 can be positioned under the annular diaphragm 60. The support pad 62 could be formed from plastic, rubber or other materials known to those skilled in the art to provide sufficient support.

As shown in FIG. 4, the polishing table 50 has the configuration of a wheel with openings 54. The outer circumference of the polishing table 50 forms the rim of the wheel. The openings 54 form an annular trench 64 in the polishing area 56. Thus, the term "trench" as used herein includes both milled channels and milled trenches that extend through the polishing table 12. The polishing pads 62 is supported by the annular diaphragm 60.

A fluid directing mechanism 66 is positioned under the polishing table 50 at a predetermined area of the annular configured polishing area 56 in which a semiconductor wafer is to be positioned for directing fluid under pressure upward through the openings 54 as the polishing table 50 rotates and onto the bottom surface of the annular diaphragm via the support pad 62, and exerts an upward biasing pressure onto the annular diaphragm. Thus, a desired counter force is imparted against any downward pressure exerted against a semiconductor wafer during chemical-mechanical polishing.

In one aspect of the present invention, the fluid directing mechanism is formed as a circular fluid head 68 similar in function to a shower head having a plurality of fluid directing orifices 70 through which fluid is directed through the fluid head 68 upward against the support pad. The annular diaphragm 60 has a top surface that is substantially coplanar with the top surface of the polishing table. The source of fluid 72 that can be connected to the fluid directing mechanism can be a source of air 74 or source of water 76. A controller 80 can be connected to the source of air or source of fluid for providing the necessary pressure control to change the pressure exerted against the diaphragm.

Thus, the annular diaphragm provides the necessary control over the structure and polishing operation. Naturally, the term "annular diaphragm" corresponds to having separate pie-shaped pieces that are supported by the "wheel spokes" forming the plurality of supports. Thus, the overall structure of the separate pieces would form an annular diaphragm and function purposes.

The present invention is advantageous because it now allows very desirable chemical-mechanical polishing operation where a single layer hard pad can be used on conjunction with the low down force of less than 5 pounds psi and a high table speed. The use of the metal diaphragm with the formed trench or channel is advantageous as noted above.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A method of chemical-mechanical polishing comprising the steps of:

rotating a polishing table having a polishing pad positioned at an annular configured polishing area;

directing a chemical-mechanical polishing slurry onto the polishing pad while biasing a semiconductor wafer carried by a wafer carrier into the polishing pad for planarizing a surface of the semiconductor wafer;

exerting a counter force against the downward pressure exerted by the wafer carrier onto the semiconductor wafer by actuating fluid pressure upward through an annular trench formed in the polishing table at the annular configured polishing area and onto the bottom surface of an annular diaphragm that is positioned under the polishing pad; and controlling the fluid pressure for changing the counter-force and upward biasing pressure against the bottom surface of the annular diaphragm.

2. A method according to claim 1, and further comprising the step of forming the annular diaphragm from a thin metal material.

3. A method according to claim 1, and further comprising the step of forming the annular diaphragm substantially coplanar with the top surface of the polishing table.

4. A method according to claim 1, and further comprising the step of actuating fluid pressure by supplying air under pressure.

5. A method according to claim 1, and further comprising the step of actuating fluid pressure by forcing fluid through concentric fluid carrying tubes positioned in the annular trench.

6. A method of chemical-mechanical polishing comprising the steps of:

rotating a polishing table having an annular configured trench and a polishing pad positioned over the annular configured trench;

directing a chemical-mechanical polishing slurry onto the polishing pad while biasing a semiconductor wafer carried by a wafer carrier into the polishing pad for planarizing a surface of the semiconductor wafer;

exerting a counter force against downward pressure exerted by the wafer carrier onto the semiconductor carrier by actuating fluid pressure carried by a plurality of concentric fluid carrying tubes positioned in the annular trench upward against an annular diaphragm that is positioned at under the polishing pad; and controlling the fluid pressure for changing the counter-force and upward biasing pressure against the bottom surface of the annular diaphragm.

7. A method according to claim 6, and further comprising the step of forming the annular diaphragm from a thin metal material.

8. A method according to claim 6, and further comprising the step of forming the annular diaphragm substantially coplanar with the top surface of the polishing table.

9. A method according to claim 6, and further comprising the step of actuating pressure by supplying air under pressure through an air pump.

10. A method according to claim 6, and further comprising the step of biasing a flexible matrix via the fluid carrying tubes contained therein for actuating fluid pressure against the annular diaphragm.

11. A method according to claim 10, and further comprising the step of forming the matrix from rubber.

12. A method according to claim 6, and further comprising the step of discharging air through the fluid carrying tube for varying pressure within the tube.

13. A method of chemical-mechanical polishing comprising the steps of:

rotating a polishing table having a polishing pad positioned at an annular configured polishing area;

directing a chemical-mechanical polishing slurry onto the polishing pad while biasing a semiconductor wafer carried by a wafer carrier into the polishing pad for planarizing a surface of the semiconductor wafer; and exerting a counter force against the downward pressure exerted by the wafer carrier onto the semiconductor wafer by actuating fluid pressure upward through an annular trench formed in the polishing table at the annular configured polishing area and onto the bottom surface of an annular diaphragm that is positioned under the polishing pad and formed substantially coplanar with the top surface of the polishing table.

14. A method of chemical-mechanical polishing comprising the steps of:

rotating a polishing table having an annular configured trench and a polishing pad positioned over the annular configured trench;

directing a chemical-mechanical polishing slurry onto the polishing pad while biasing a semiconductor wafer carried by a wafer carrier into the polishing pad for planarizing a surface of the semiconductor wafer; and exerting a counter force against downward pressure exerted by the wafer carrier onto the semiconductor carrier by actuating fluid pressure carried by a plurality of concentric fluid carrying tubes positioned in the annular trench upward against an annular diaphragm that is positioned at under the polishing pad and formed substantially coplanar with the top surface of the polishing table.

* * * * *

UNITED STATES PATENT AND TRADEMARK OFFICE

CERTIFICATE OF CORRECTION

PATENT NO. : 6,217,419 B1
DATED : April 17, 2001
INVENTOR(S) : Maury et al.

It is certified that error appears in the above-identified patent and that said Letters Patent is hereby corrected as shown below:

Column 5,
Line 23, delete "pads 62", substitute -- pad 64 --

Signed and Sealed this

Eleventh Day of December, 2001

*Attest:*

Nicholas P. Godici

NICHOLAS P. GODICI
*Acting Director of the United States Patent and Trademark Office*

*Attesting Officer*